US005199714A

United States Patent [19]

Harper

[11] Patent Number: 5,199,714

[45] Date of Patent: Apr. 6, 1993

[54] METHOD OF PLAYING A WORD SOLITAIRE CARD GAME

[76] Inventor: Dorothy D. Harper, 110 N. Holmes, Kirkwood, Mo. 63122

[21] Appl. No.: 637,333

[22] Filed: Apr. 22, 1991

[51] Int. Cl.[5] ..... A63F 1/00

[52] U.S. Cl. ..... 273/299; 434/172

[58] Field of Search ..... 273/299, 272, 302; 434/172, 171

[56] References Cited

U.S. PATENT DOCUMENTS

| | | | |
|---|---|---|---|
| 1,012,574 | 12/1911 | Adams | 273/299 |
| 1,076,307 | 10/1913 | Nicholson | 273/299 |
| 1,332,249 | 3/1920 | Feero | 273/299 |
| 3,654,712 | 4/1972 | Bagdasar | 273/299 |
| 4,192,513 | 3/1980 | Feeley et al. | 273/299 |
| 4,219,197 | 8/1980 | Acuff | 273/299 |
| 4,333,656 | 6/1982 | Sommer | 273/299 |
| 4,428,562 | 1/1984 | Smith | 273/299 |

OTHER PUBLICATIONS

"Games With Playing Cards", by Joseph Leeming, Franklin Watts, Inc., 1950, pp. 22–24.

*Primary Examiner*—Benjamin Layno

[57] ABSTRACT

A deck of 52 standard-sized playing cards, with 50 cards, each having one letter of the alphabet on its obverse side, and 2 cards each having nothing on its obverse side; the blanks standing for any letter of the alphabet. The distribution of the letters in the deck is as indicated on the attached FIG. 4. The cards are arranged and combined in a word-forming game following the general organizational principles of Klondike Solitaire.

1 Claim, 2 Drawing Sheets

FIG. 4

LETTER DISTRIBUTION of Playing Cards:

| | | | | | | | |
|---|---|---|---|---|---|---|---|
| A | 3 | I | 3 | Q | 1 | Y | 2 |
| B | 1 | J | 1 | R | 2 | Z | 1 |
| C | 2 | K | 1 | S | 2 | Blank | 2 |
| D | 2 | L | 2 | T | 2 | | |
| E | 4 | M | 2 | U | 2 | | |
| F | 1 | N | 2 | V | 2 | | |
| G | 2 | O | 3 | W | 2 | | |
| H | 2 | P | 2 | X | 1 | | |

METHOD OF PLAYING A WORD SOLITAIRE CARD GAME

BACKGROUND OF THE INVENTION

Klondike Solitaire, played with a conventional deck of cards, has long been an interesting pastime. This invention employs the use of standard-sized playing cards which are arranged and played consistent with the organizational principles of Klondike Solitaire. However, this invention replaces the 4-suit, 2-color, 52 card conventional deck, with a 52 card deck containing 50 cards marked with a letter of the alphabet and 2 "blank" cards which can stand for any letter in the alphabet. The result is a novel and interesting word-forming game that is easy to play. This game combines chance and skill.

Through the years, many inventors have devised letter card games. We make reference to the following to show how they differ from the game in this specification.

E. F. Adams U.S. Pat. No. 1,012,574 December, 1911

This game uses 53 letter cards each with a suit designation to play a casino-type game.

C. M. Nicholson U.S. Pat. No. 1,076,307 October, 1913

This is a 72 card game using letters and numbers in order to make words and sentences. The cards are dealt to 4 or more players.

S. H. Feero U.S. Pat. No. 1,332,249 March, 1920

This game has four complete alphabets with two different letters on each of 52 cards along with numbers. Any number of players receive three cards at a time with the remaining cards being put in a pile.

Florica Bagdasar U.S. Pat. No. 3,654,712 April, 1972

These letter cards are contained in a kit which becomes a teaching aid for kindergarten and 1st grade children who are learning the alphabet and the various sounds of the letters.

John and Ruth Feeley U.S. Pat. No. 4,192,197 March, 1972

This game has 104 diamond-shaped playing cards, each having a 3-letter sequence and a suit symbol in which melds are made.

Daniel Acuff U.S. Pat. No. 4,219,197 August, 1980

This game uses 68 cards with a letter and a word component and a suit designation on each card. There is also a 6-sided row designator to play a word forming game following the organization of poker.

Steven Sommer U.S. Pat. No. 4,333,656 May, 1982

This game has a 104-card deck of four complete alphabets with a suit marking and a numerical marking for a rummy-type word.

William Smith U.S. Pat. No. 4,428,582 January, 1980

This game uses 130 cards with a letter on one side and a number on the other. This is a solitaire-type game, the object of which is to obtain 5 sets of the alphabet.

SUMMARY OF INVENTION

In the present invention, there is provided a deck of standard-sized playing cards, each containing a letter or blank on its obverse side. The letters on each particular card are indicated in large print in the middle of the card, and in smaller print in the upper left and bottom right-hand corner of the card. All letter cards are the same color. The blank cards have no markings on the obverse side. The inverse sides of all of the cards are the same color and pattern or design. The frequency of the particular letters and blanks is shown in FIG. 4.

The cards are used to form words using the organizational principles of Klondike Solitaire. The object of the invention is to form as many words as possible, using the maximum number of cards. Ultimately, the player is attempting to use all of the cards in a word.

BRIEF DESCRIPTION OF THE DRAWINGS

FIG. 4 is a chart of the letter and "blanks" distribution in the deck of cards used in this invention.

DETAILED DESCRIPTION OF INVENTION

This invention employs the use of a deck of 52 standard-sized rectangular-shaped playing cards. As with standard playing card decks, the inverse sides of these cards are identical in color and pattern. However, the obverse sides of these cards are marked with either a letter or are left blank.

The letter and blank distribution within the deck are shown in FIG. 4. The cards are designed so that the letter indicated on the particular card is printed in large print in the middle of the card. The letter is also shown in smaller print in the upper left and lower right-hand corners of the card. Blank cards have no markings on the obverse side.

The cards are to be used to play a word-forming game, following the organizational principles of Klondike Solitaire. I call this game "Word Solitaire." This is a game to be played by one person, as with Klondike Solitaire.

Figure 1:
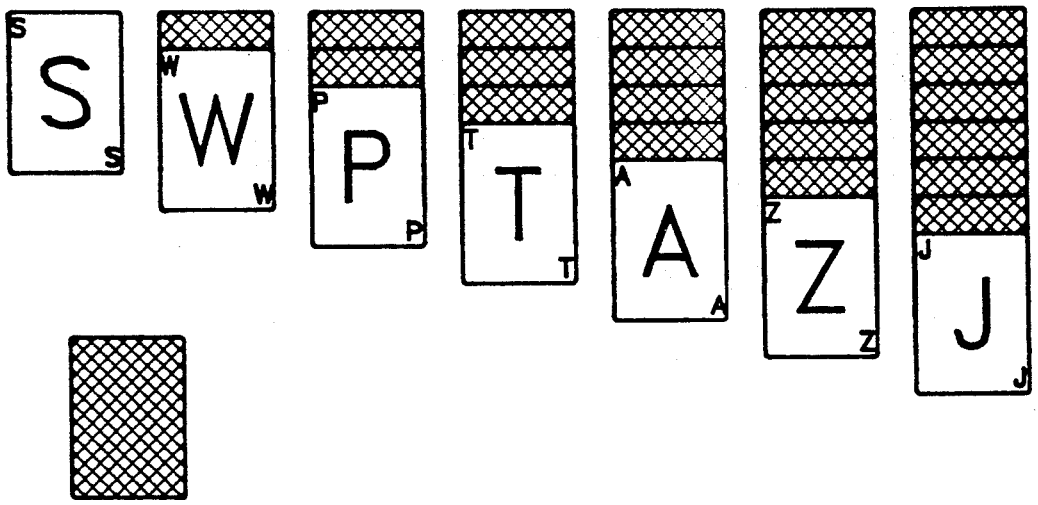
FIG. 1 shows the initial arrangement of the 28 cards into 7 stacks at the start of the game.

After shuffling the cards, the player arranges the cards in a fashion identical to Klondike Solitaire. As shown in FIG. 1, the player places the first card in the left-most column in a "face up" position, so that the letter or blank indicated on that card is visible. The player then forms 6 additional columns to the right of the first card. These cards are placed face down, so that the letters or blanks are not visible. The player then places the next card in a face up position in column No. 2, and face down cards are again placed in columns 3 through 7. The player then places a face up card in column 3 and face down cards in columns 4 through 7. This procedure continues until all 7 columns have a face up card. Please note that once a face up card is played in a column, no additional cards are placed in the column. I call the cards in each column "stacks." There are 28 cards in these stacks. The remaining 24 cards of the deck are known as the "pile" and these cards are grouped together in a face down position.

Figure 2:
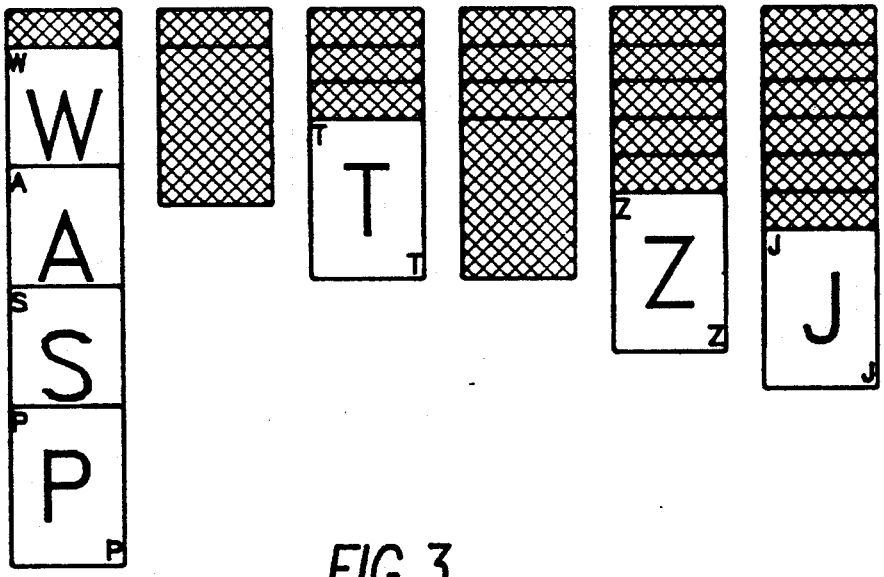
FIG. 2 shows the arrangement of the cards shown in FIG. 1 after formation of a word from the initial arrangement of letters. The top cards of rows 3 and 5 have not yet been turned over.
Figure 3:
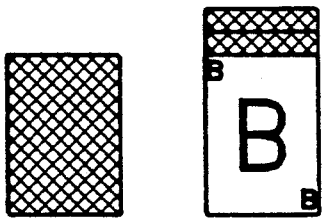
FIG. 3 shows the first set of cards played from the "pile." There are 2 cards down and 1 card up.

Once the stacks have been arranged, the player reviews the face up cards to see if any English words can be formed using the letters and blanks which are facing the player. The face down cards cannot be used at this time. The words to be formed must contain two or more letters. If a word can be formed, then the face up letters are moved from their stack to the stack where the word is being formed. This stack will be the stack containing the first letter of the word being formed. The letters must be arranged in accordance with the proper spelling of the word. FIG. 2 shows how the word "wasp" is formed using the "W" of column 2 with the "A" from column 5, the "S" of column 1 and the "P" of column 3.

When the face up letters or blanks have been used to form a word, the face down card immediately below that card may be turned over. This card may then be added to the existing word in the other stack, or may be shifted to another stack if another word can be formed. If a stack becomes vacant because the cards have been used in making words, then a face up card from another stack may be placed in a face up position in the vacant column. For example, in FIG. 2, column 1 has become vacant because the "S" was used to form a word. In this situation, the "T," "Z," or "J" from columns 4, 6 or 7 could be moved to a face up position in column 1. The card which was underneath the card used to fill the vacancy may then be turned face up.

Once a word has been formed, it is removed from the stacks and is kept in a face up position in the game area. Once the word is removed from the board, no further cards can be added to the word, nor can cards be removed from the word. If the word was taken from a stack where face down cards remained, then the topmost face down card of that stack can be turned face up.

Once the player is satisfied that no further words can be formed from the face up cards in the stacks, then the player starts playing cards from the pile. Starting from the top of the pile, the player places 2 cards face down and the third card face up. I will call this a "mini stack." If the face up card of the "mini stack" can be used to form a word with any of the letters in the stacks, or if any of the stacks are vacant, then it may be moved to the appropriate stack. The down card in the mini stack may then be turned over and played in the same fashion as the original face up card in the mini stack. If a card from the mini stack cannot be played, then the player continues drawing mini stacks from the pile. The play continues until the player can form no additional words from the face up cards in the stacks or mini stacks. The object of the game is use all of the cards in the deck forming words.

What I claim as new and desire to secure by letters patent of the United States is:

1. A method of playing a word forming solitaire-type card game comprising the step of:

a) providing a deck of fifty-two cards, said deck having fifty cards each, having only one letter of the alphabet on its obverse side, wherein said fifty cards represent all the letters of the alphabet, and two blank cards each having no indicia on its obverse side, said blank cards representing any letter of the alphabet, the reverse side of all fifty-two cards being identical;

b) arranging a row of seven separate stacks on a flat surface by dealing the top card of the deck face up to form a first stack, dealing one card face down and a second card face up on top of the face down card to form a second stack, dealing two cards face down and a third card face up on top of the two face down cards to form a third stack, continuing this process until seven stacks are formed comprising twenty-eight cards, each stack having a face up card at the top, setting aside the remaining cards in a face down pile;

c) attempting to form at least one word or the first portion of at least one word using said face up cards;

d) moving said face up cards and placing said face up cards in correct spelling order below the face up card or cards having the letter or letters starting said at least one word or said first portion of said at least one word, if no complete word is formed, continuing to step (f);

e) if said at least one word is completely formed, removing to one side said face up cards spelling said at least one word;

f) turning face up the top card of the stacks having no face up cards, and if a stack is vacant of cards, moving an extra card from any stack and placing said card face up in said previously vacant stack wherein each of said seven stacks have a face up card; if there is no extra card in any of the other stacks to fill a vacant stack, taking a card from the face down pile to fill said vacant stack, if at least one word can be formed using said face up card, repeating steps (d) and (e);

g) when said stack can no longer form a word, taking three cards at one time from said face down pile to form a mini stack, if the top card of said mini stack can be used toward forming a word in one of said seven stacks, playing said card on said stack, if the second card of said mini stack can be used toward forming a word, playing said second card on said stack, continue playing the third card of said mini stack if it can be used toward forming a word, then continue taking three cards from said face down pile to form another mini stack, whenever a top card of a mini stack cannot be used to form a word, return return the mini stack to the face down pile and take another three cards;

h) continuing play until either all the cards are used in words or the top cards in the mini stacks cannot yield words.

* * * * *